United States Patent [19]

McDonald et al.

[11] Patent Number: 4,880,065

[45] Date of Patent: Nov. 14, 1989

[54] AIR MOTOR OPERATED ROTARY EARTH DRILLING TOOL

[75] Inventors: William J. McDonald; Michael R. Wasson; Curtis E. Leitko; Gerard T. Pittard; William C. Maurer, all of Houston, Tex.

[73] Assignee: Gas Research Institute, Chicago, Ill.

[21] Appl. No.: 258,175

[22] Filed: Oct. 14, 1988

[51] Int. Cl.[4] ..... E21B 4/02; F03B 13/02

[52] U.S. Cl. ..... 175/71; 175/100; 175/107; 175/317; 415/116; 415/145; 415/148; 415/176; 415/180; 415/903; 173/63; 173/65

[58] Field of Search ..... 175/65, 71, 100, 101, 175/103, 107, 106, 321, 324, 317; 166/104; 173/63-65, 73, 78, 80; 415/110-112, 502, 503, 108, 116, 144, 145, 148, 175-177, 180; 418/83, 86, 91

[56] References Cited

U.S. PATENT DOCUMENTS

| | | | |
|---|---|---|---|
| 2,865,602 | 12/1958 | Whittle | 175/107 |
| 3,194,325 | 7/1965 | Gianelloni, Jr. | 175/26 |
| 3,989,114 | 11/1976 | Tschirky et al. | 175/317 |
| 4,019,592 | 4/1977 | Fox | 175/107 |
| 4,103,749 | 8/1978 | Erickson | 415/502 |
| 4,260,031 | 4/1981 | Jackson, Jr. | 175/107 |
| 4,298,077 | 11/1981 | Emery | 175/107 |
| 4,434,862 | 3/1984 | Lyons | 175/103 |
| 4,546,836 | 10/1985 | Dennis et al. | 175/107 |
| 4,553,611 | 11/1985 | Lyons | 175/71 |
| 4,678,045 | 7/1987 | Lyons | 175/61 |

*Primary Examiner*—Bruce M. Kisliuk
*Attorney, Agent, or Firm*—Neal J. Mosely

[57] ABSTRACT

A new and improved air motor operated rotary earth drilling tool for use with a source of high pressure, high volume compressed air has a circulation control housing, a motor housing, a reduction gear housing, and a bearing housing connected longitudinally in series. The circulation control housing is connected to high pressure, high volume, compressed air and has an outlet opening into the motor housing, and an exhaust opening for discharge of compressed air for flushing cuttings and debris from a bore hole which is controlled by longitudinal movement of an inlet tube. The motor housing has a motor chamber and a sliding vane rotor with a rotary shaft extending into the reduction gear housing. A planetary reduction gear receives the rotor shaft and has a low speed, high torque output shaft extending into the bearing housing. A passageway conducts compressed air around the planetary reduction gear for cooling. A radial and thrust bearing pack in the bearing housing is connected to the planetary reduction gear output shaft. A hollow, rotary drill bit sub extends into the bearing housing and is supported on the bearing pack for rotation by the planetary reduction gear. Part of the compressed air operating the motor and cooling the planetary reduction gear is discharged through the drill bit sub and part flows though the bearing pack for cooling and discharge into the bore hole.

29 Claims, 5 Drawing Sheets

AIR MOTOR OPERATED ROTARY EARTH DRILLING TOOL

BACKGROUND OF THE INVENTION

1. Field of the Invention

This invention relates generally to air operated earth drilling tools, and more particularly to rotary air motor operated earth drills.

2. Brief Description of the Prior Art

The prior art shows a number of examples of air motors used in earth drilling.

Van Huisen U.S. Pat. No. 3,899,033 discloses a pneumatic-kinetic drilling system which relies on the weight and reciprocation of the drill string to drive a piston-cylinder combination to compress air. The compressed air is in turn used to rotate and hammer the drill bit. There is no use of a circulating sub in his patent.

Lyons et al. U.S. Pat. No. 4,432,423 discloses apparatus for extended straight line drilling from a curved borehole.

Lyons U.S. Pat. No. 4,553,611 discloses a pressure drop regulator for downhole turbines.

Schellstede U.S. Pat. No. 4,640,362 discloses a penetration apparatus and method for perforating casing with a high pressure fluid driven punch.

Fox U.S. Pat. No. 4,019,592 discloses a by-pass tool which prevents flow of fluid to all drill string components located below the tool when activated. There is no suggestion to flow all the air through the annulus formed from the outer housing and inner motor/gear box to the drill bit to improve hole cleaning. This tool achieves closure of the by-pass with little or no downward force using opposing seal diameters.

Whittle U.S. Pat. No. 2,865,602 discloses a hydraulic turbine with a by-pass valve integral with the motor. The by-pass is closed when the bit is brought into contact with the bottom of the hole. This brings the telescopic bit stem up against a set of abutments which pushes the sleeve connected to the bit into its upper position causing the mud to pass through the turbine blading. On lifting the drill string off bottom the sleeve is pulled into its lower position by the combined action of gravity and pressure drop across the bit openings. The openings are no longer in register which causes the flow of mud to by-pass the turbine blading.

Gianelloni U.S. Pat. No. 3,194,325 discloses a control valve for turbodrills which provides a means for conducting all the mud supplied to the body to the drill bit while only a portion passes through the turbine for driving the bit. This uses bit weight to close the valve and removal or bit weight to activate the by-pass feature. This patent has a valve and valve seat structure which makes a metal to metal contact when sufficient weight is applied to the drill bit. The weight of the drill is carried through a compression spring. This design of valve is not very effective (ease of opening or closing) in horizontal holes or when air is used as the drilling fluid due to the loss in pump open force and gravity vector.

Lyons U.S. Pat. No. 4,678,045 discloses a turbine tool which includes a method of routing air around the outer diameter of the planetary gear reduction to the drill bit when the motor is operating and enables spent power fluid to be used as drilling fluid and has a bit sub connected to the output shaft of the last stage of gear reduction and supported from the end of the housing which is opposed to the turbine motor.

The present invention is distinguished over the prior art in general, and these patents in particular by a new and improved air motor operated rotary earth drilling tool having a circulation control for inlet air, a rotary air motor, a planetary reduction gear, and a bearing pack connected in series, air from the motor passing over the reduction gear for cooling and through the bearing pack for cooling and discharge into the borehole.

SUMMARY OF THE INVENTION

It is therefore an object of the present invention to provide a new and improved rotary air motor operated earth drilling apparatus.

It is another object of this invention is to provide a new and improved rotary air motor operated earth drilling apparatus having a selective control of air flow to the motor or to discharge into the borehole to clean the bit and remove cuttings from the hole.

Another object of this invention is to provide a new and improved rotary air motor operated earth drilling apparatus having an air inlet tube movable to operate a valve for selective control of air flow to the motor or to discharge into the borehole to clean the bit and remove cuttings from the hole.

Another object of this invention is to provide a new and improved rotary earth drilling apparatus driven by a rotary, sliding-vane-type, air motor.

Still another object of this invention is to provide a new and improved rotary air motor operated earth drilling apparatus having a vane-type rotary motor, a planetary reduction gear and a bearing pack of radial and thrust bearings.

Still another object of this invention is to provide a new and improved rotary air motor operated earth drilling apparatus having a vane-type rotary motor, a planetary reduction gear and a bearing pack of radial and thrust bearings with the air flow directed to operate the motor and to clean and cool the reduction gear and bearing pack.

A further object of this invention is to provide an improved rotary air motor operated earth drilling apparatus having a vane-type rotary motor, a planetary reduction gear and a bearing pack of radial and thrust bearings supported in separate housings interconnected as a tool assembly.

Other objects of the invention will become apparent from time to time throughout the specification and claims as hereinafter related.

The above noted objects and other objects of the invention are accomplished by a new and improved air motor operated rotary earth drilling tool for use with a source of high pressure, high volume compressed air which has a circulation control housing, a motor housing, a reduction gear housing, and a bearing housing connected longitudinally in series. The circulation control housing is connected to high pressure, high volume, compressed air and has an outlet opening into the motor housing, and an exhaust opening for discharge of compressed air for flushing cuttings and debris from a borehole which is controlled by longitudinal movement of an inlet tube. The motor housing has a motor chamber and a sliding vane rotor with a rotary shaft extending into the reduction gear housing. A planetary reduction gear receives the rotor shaft and has a low speed, high torque output shaft extending into the bearing housing.

A passageway conducts compressed air around the planetary reduction gear for cooling. A radial and thrust bearing pack in the bearing housing is connected to the planetary reduction gear output shaft. A hollow, rotary drill bit sub extends into the bearing housing and is supported on the bearing pack for rotation by the planetary reduction gear. Part of the compressed air operating the motor and cooling the planetary reduction gear is discharged through the drill bit sub and part flows though the bearing pack for cooling and discharge into the borehole.

DESCRIPTION OF ONE PREFERRED EMBODIMENT

Figure 1A:
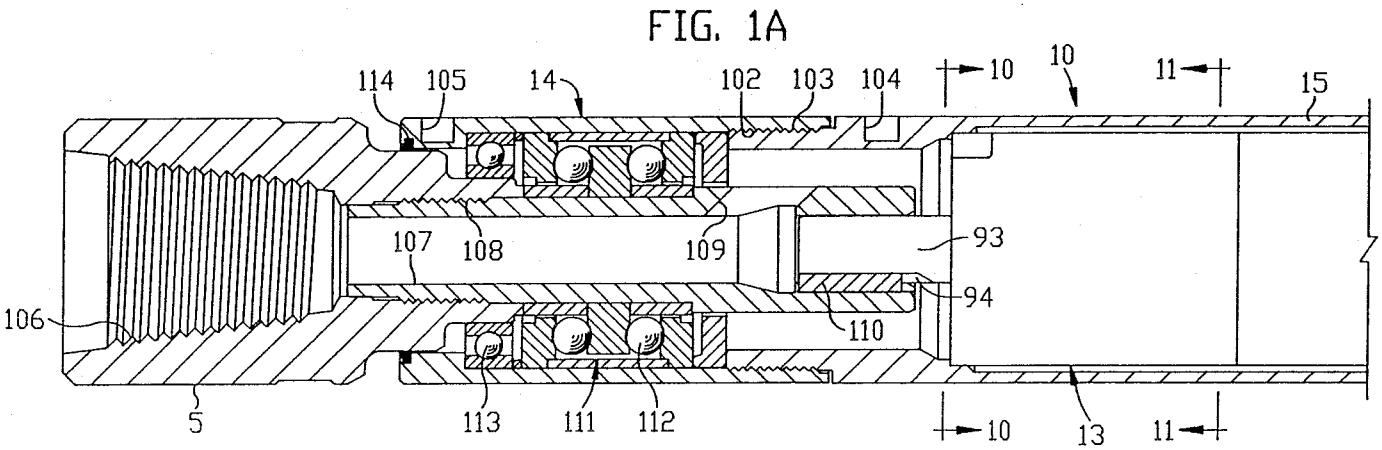
FIGS. 1A and 1B together form a broken, longitudinal cross section of an air motor operated rotary earth drilling tool illustrating a preferred embodiment of this invention with the air circulation control valve in a open position.
Figure 1B:
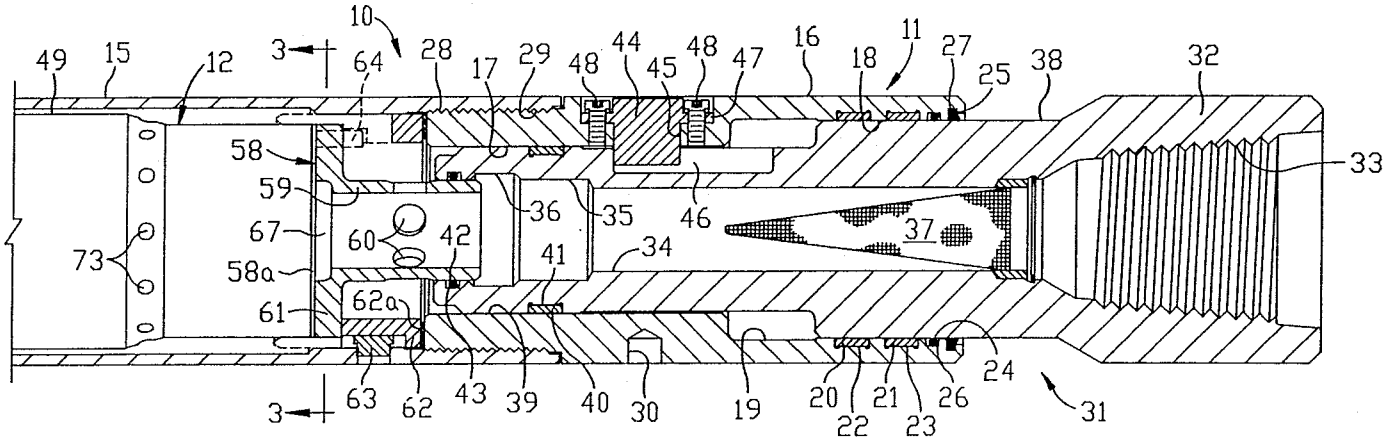
Figure 2:
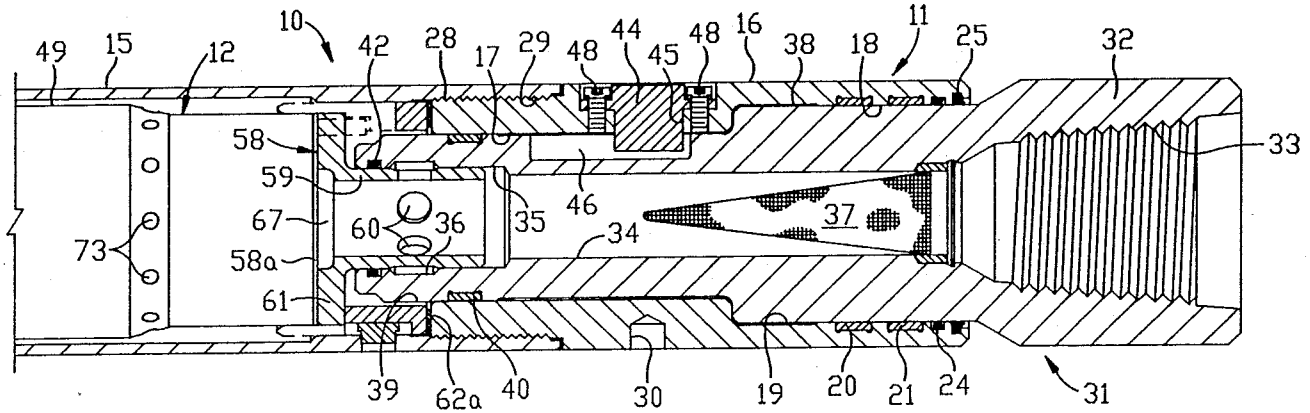
FIG. 2 is a longitudinal cross section of an air motor operated rotary earth drilling tool, with the portion shown in FIG. 1A having the air circulation control valve in a closed position.
Figure 4:
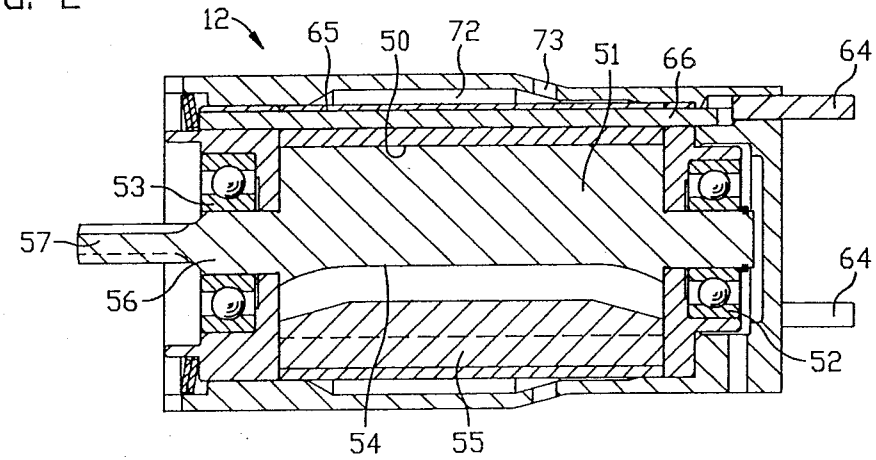
FIG. 4 is longitudinal cross section of the air motor housing and sliding vane motor on the line 4—4 of FIG. 6.
Figure 3:
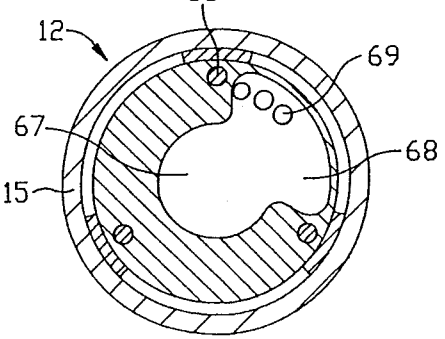
FIG. 3 is a section taken on the line 3—3 of FIG. 1A showing the air distributor to the air motor.
Figure 6:
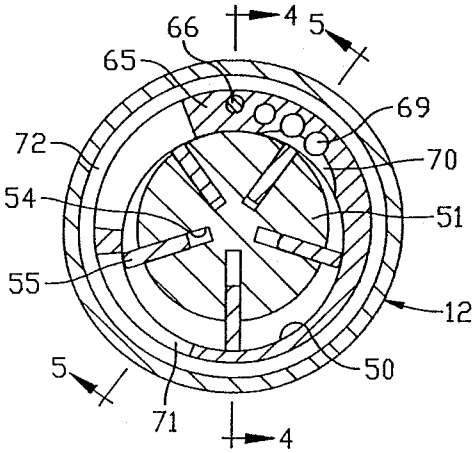
FIG. 6 is a cross section of the air motor housing and sliding vane motor on the section line 6—6 of FIG. 5.
Figure 5:
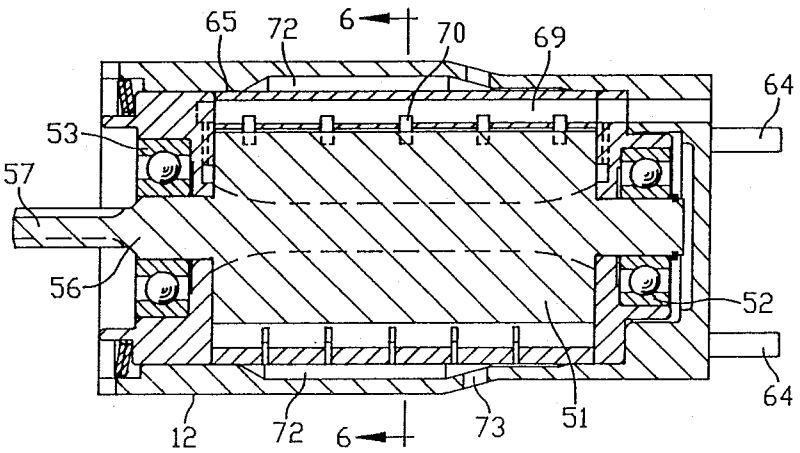
FIG. 5 is longitudinal cross section of the air motor housing and sliding vane motor on the line 5—5 of FIG. 6.

Referring to the drawings by numerals of reference, and more particularly to FIGS. 1A, 1B and 2, there is shown an air motor operated rotary earth drilling tool 10 for use with a source of high pressure (e.g. 100 p.s.i.), high volume compressed air. The view shown in FIGS. 1A and 1B is a longitudinal section of the tool 10 broken at about the mid point with the forward or downhole end shown in FIG. 1A and the rearward or upper end shown in FIG. 1B. As will be described below, FIG. 2 is the same structure as FIG. 1B, but in a valve closed position.

Earth drilling tool 10 comprises a housing assembly including a circulation control housing 11, a motor housing 12, a reduction gear housing 13, and a bearing housing 14 connected longitudinally in series. An external housing 15 supports motor housing 12, and reduction gear housing 13, to prevent rotational movement. Circulation control housing 11 and bearing housing 14 are threadedly secured to opposite ends of external housing 15.

Circulation control housing 11 comprises a tubular housing member 16 with an inner bore 17, a counterbore 18, and an undercut bore 19. Counterbore 17 has bearing rings 20 and 21 in grooves 22 and 23, and sealing O-ring 24 in groove 26, and wiper ring 25 in groove 27. Tubular housing member 16 has a male threaded end or pin 28 threaded into a female threaded end or box 29 of external housing 15 and has a recess 30 for receiving a wrench or other tool for making or breaking the connection.

A tubular inlet member 31 is slidably positioned in counterbore 17 and 18 of circulation control housing 11. Tubular inlet member 31 has an enlarged outer end portion 32 with female or box threads 33 opening into longitudinal passageway 34. Passageway 34 has a counterbore 35 and undercut 36 at its inner end. A conical screen filter 37 is fitted in the outer end of passageway 34 adjacent to the box portion 33.

Tubular inlet member 31 has an intermediate portion 38 with an O.D. having a sliding fit in counterbore 18 of housing member 16 and is sealed against air leakage by bearing rings 20 and 21 and sealing O-ring 24 and wiper ring 25. Tubular inlet member 31 has a further portion 39 with an O.D. having a sliding fit in inner bore 17 of housing 11 and is sealed against air leakage by a bearing ring 40 in groove 41 and a sealing O-ring 42 in groove 43 in the I.D. of counterbore 35.

A plurality of abutment plugs 44 are secured in openings 45 in the wall of housing member 16 and extend respectively into recesses 46 in the smaller diameter portion 39 of tubular inlet member 31 to prevent rotational movement, to limit longitudinal movement thereof and to prevent it from being removed from housing member 16 during use. Abutment plugs 44 each have a flange portion 47 through which metal screws 48 extend to hold the plugs in plate. There are three of the abutment plugs 44 and recesses 46 spaced uniformly around the circulation control housing 11, although a greater or lesser number may be used as desired.

Referring to FIGS. 3–6, and 11, motor housing 12 is supported centrally in external housing 15 with an annular passageway 49 (FIG. 11) providing a passage for air flow around the motor. Motor housing 12 has an eccentric motor cavity 50 with a rotor 51 supported for rotation on ball bearing assemblies 52 and 53. Rotor 51 has a plurality of slots 54 with sliding vanes 55 therein. Rotor 51 has a shaft 56 with a pinion gear 57 at its end which fits into the planetary reduction gear as described below.

An air distributor member 58 (FIG. 1B) has a central tubular portion 59 with a plurality of outlet holes 60 and a flange portion 61 secured to the end of motor housing 12. A gasket 58*a* seals the connection of air distributor member 58 to motor housing 12. A spacer member 62 is positioned against shim 62*a* and the end of housing 16 and is secured against rotation by abutment plug 63. Air distributor member 58 is positioned against spacer member 62 and secured against rotation by pins 64 on motor housing 12. An internal housing member 65 (FIG. 4) is supported inside housing 12 and secured against rotation by pin 66.

Air distributor member 58 has a central opening 67 which opens through a passage 68 to the ends of passages 69 extending through the motor internal housing 65. Passages 67, 68 and 69 conduct compressed air to inlet cavities 70 to act against vanes 55 to rotate the motor rotor 51. Air leaving the vanes 55 exits through opening 71 into the annulus 72 between housings 12 and 65 and out through openings 73 into the annular passageway 49 in external housing 15.

Figure 7:
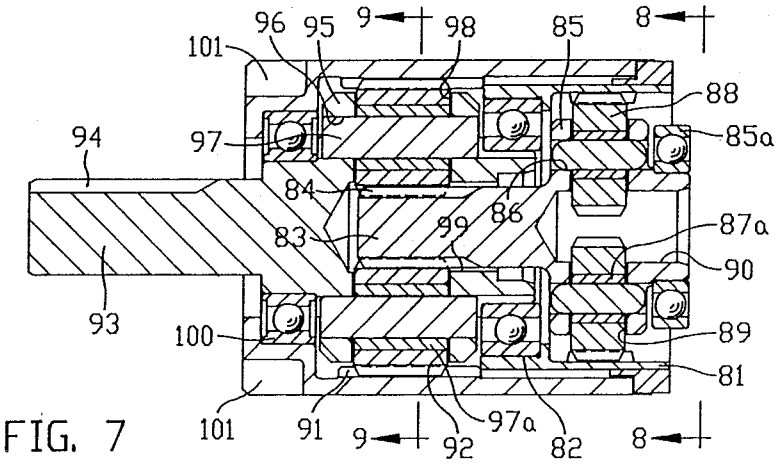
FIG. 7 is longitudinal cross section of the reduction gear housing and planetary reduction gear.
Figure 8:
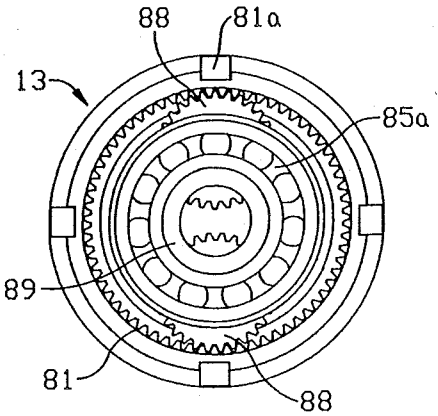
FIG. 8 is a right end elevation of the reduction gear housing and planetary reduction gear viewed from the line 8—8 of FIG. 7.

Referring to FIG. 7, reduction gear housing 13 supports a planetary gear which reduces the high speed, low torque output of motor shaft 56 to a low speed, high torque output to the bearing pack and bit box. The planetary reduction gear may be of any conventional design but is shown as a two stage planetary construction. Gear housing 13 (FIG. 8) has a first ring gear 81 which is fixed in position by four keys 81*a* and supports a ball bearing assembly 82 for the second stage of the reduction gear.

The first reduction stage has a supporting cage or spider 85 with an output shaft 83 and pinion gear 84 thereon. The supporting spider or cage 85 is slotted at 89 (FIG. 8) to receive planet gears 88. Holes 86 in spider or cage 85 receive pins 87 and bearings 87*a* supporting planet gears 88 which roll in ring gear 81. The end of spider or cage 85 is positioned in bearing 85*a* and has a central passage 90 through which rotor shaft 56 extends with pinion gear 57 positioned to operate planet gears 88. The speed of rotation of motor shaft 56 is reduced by the ratio of motor pinion gear (sun gear) 57 to planet gear 88 to ring gear 81 cause output shaft 83 to rotate at a correspondingly slower speed.

Figure 9:
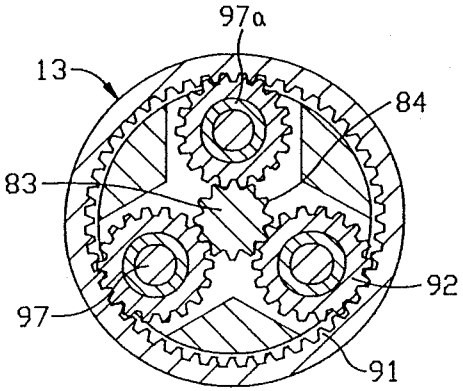
FIG. 9 is a cross section of the reduction gear housing and planetary reduction gear on the line 9—9 of FIG. 7.
Figure 11:
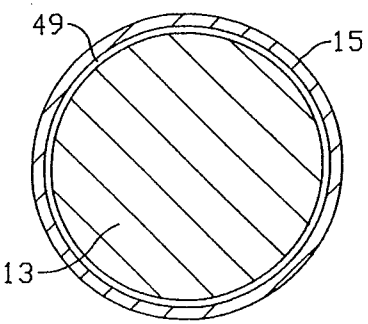
FIG. 11 is a cross section on the section line 11—11 of FIG. 1A showing the annular discharge passage around the motor and reduction gear housings.
Figure 10:
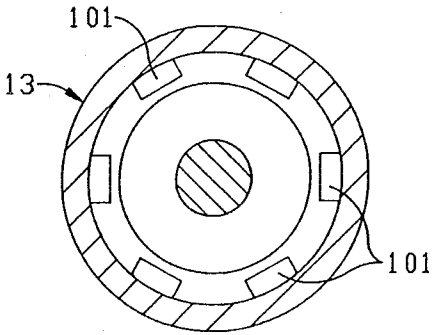
FIG. 10 is a cross section on the section line 10—10 of FIG. 1A showing the air discharge passages around the end of the reduction gear housing.

The second reduction stage (FIG. 9) comprises ring gear 91 in which there roll a plurality of planet gears 92. A supporting cage or spider 95 has an output shaft 93 with a keyway 94 for connection to the bearing assembly. The supporting spider or cage 95 is slotted at 98 to receive planet gears 92. Holes 96 in spider or cage 95 receive pins 97 and bearings 97*a* supporting planet gears 92 which roll in ring gear 91. One end of spider or cage 95 is positioned in bearing 82 and has a central passage 99 through which output shaft 83 extends with pinion gear 84 positioned to operate planet gears 92. The other end of spider or cage 95 and output shaft 93 are supported for rotation on a ball bearing assembly 100. Speed of rotation of output shaft 83 is reduced by the ratio of output shaft (sun gear) 83 to planet gear 92 to ring gear 91 cause output shaft 93 to rotate at a correspondingly slower speed. A plurality of notches 101 (FIGS. 7 and 10) in reduction gear housing 13 provide passages for air flowing through annular passageway 49 into the bearing pack.

Referring to FIG. 1A, there are shown details of the bearing pack and drill bit box. Bearing housing 14 is tubular in construction and has one end with female or box threads 102 threaded on the male threaded portion or pin 103 of external housing 15. Housing 15 has a recess 104 and housing 14 has a recess 105 for receiving a wrench or other tool for making or breaking the connection.

A hollow bit sub S is supported in the open end of housing 14 and comprises an enlarged box threaded portion 106 and a hollow shaft 107 threaded together as at 108. Shaft 107 has a side opening 109 for discharge of air flowing through the tool. The end of shaft 107 receives gear output shaft 93 and has a key member 110 fitting keyway 94 to provide a non-slip connection. A ball bearing assembly 111 is secured part on shaft 107 and part on housing 14 to support shaft 107 for rotation. Ball bearings 112 are arranged to take longitudinal thrust loads, while bearings 113 carry lateral thrust loads. Wiper ring 114 controls air leakage and allows a small portion of the air flowing through the tool to flow through the bearings to cool and clean them while directing the major part of the air flow through the hollow shaft and the openings in the drill bit (not shown) to blow cuttings and debris from the borehole.

OPERATION

While the operation of this invention should be obvious from the foregoing description, it will be restated for clarity.

The tool is designed for drilling through hard soil or rock. It is placed in a drilling position and compressed air is introduced through inlet member 32 of circulation control housing 11. Air flow is through motor housing 12 to rotate rotor 51. Air from the motor flows through annular passageway 49 around motor housing 12 and reduction gear housing 13 to keep them cool and dissipate heat produced by the high speed motor operation. Air flow from passageway 49 is discharged through bearing housing 14 with part of the air discharging through the peripheral opening around the bit sub past wiper ring 114 and part flowing through the bit sub to flush cuttings and debris from the borehole.

In the position shown in FIG. 2, tubular inlet member 31 is moved forward as far as possible and covers the openings 60 in the inlet air distributor plate 58 to motor housing 12. This directs all air flow through motor housing 12 to operate motor rotor 51 and discharge around the housings through passageway 49 as previously described. When the tubular member 31 is retracted, as shown in FIG. 1B, the end on tubular member 31 uncovers openings 60 and allows the air flow to proceed directly into passageway 49. In this position, there is insufficient air pressure on rotor vanes 55 to rotate the motor and all of the air flows around the housings through passageway 49. This is accomplished by lifting(in the case of vertical drilling) or pulling back (in the case of horizontal drilling) the drill string or air connection.

DESCRIPTION OF ANOTHER PREFERRED EMBODIMENT

Figure 12:
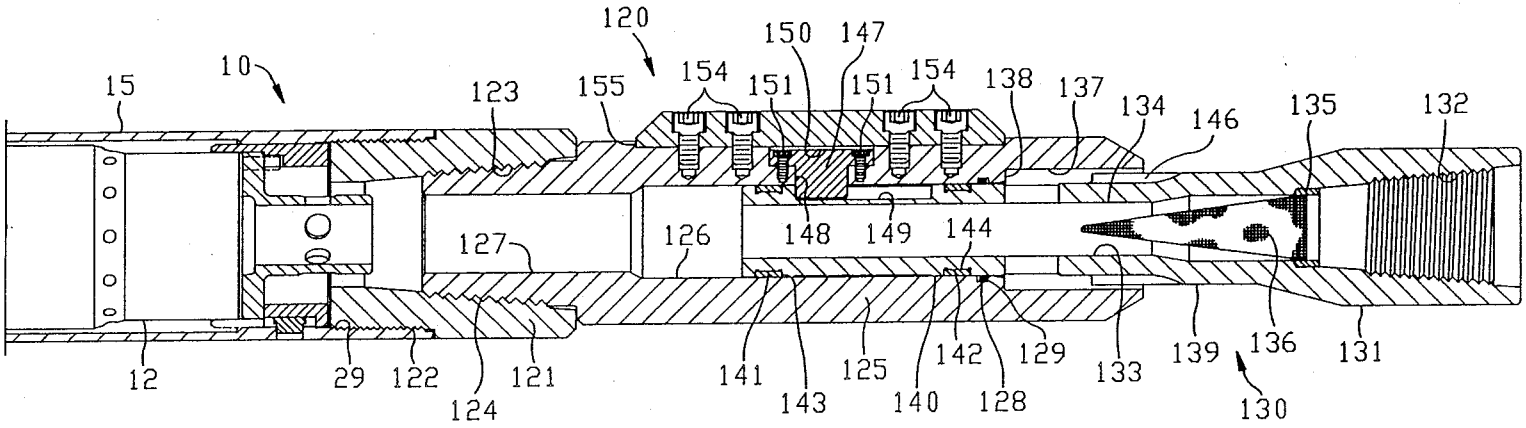
FIG. 12 is a longitudinal cross section of the inlet end of an air motor operated rotary earth drilling tool, with a separate, removable air circulation control housing, with the circulation control valve in an open position.
Figure 13:
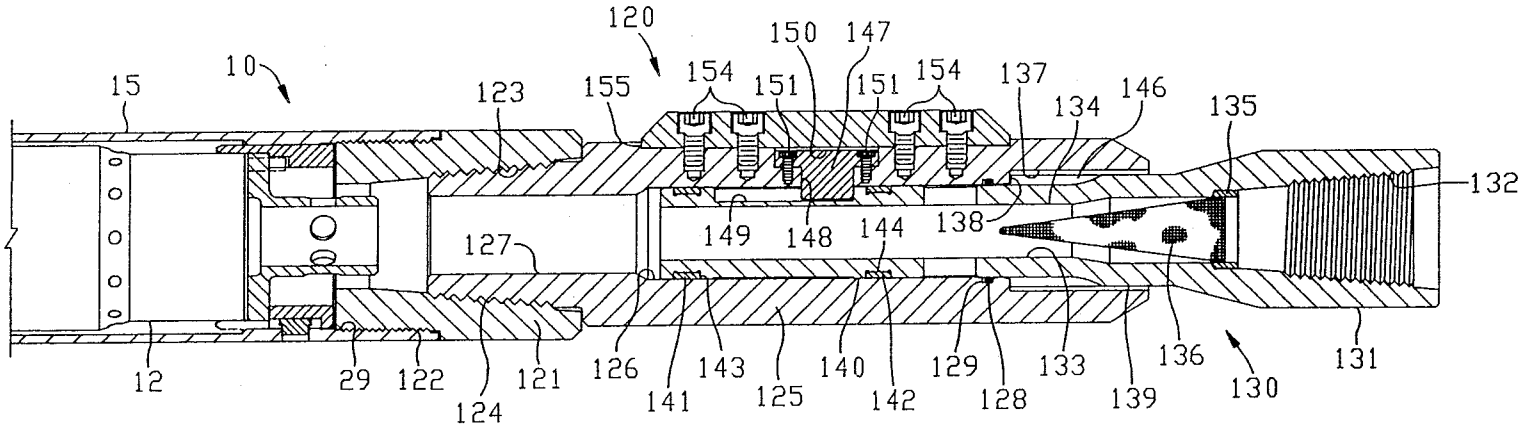
FIG. 13 is a longitudinal cross section of the inlet end of an air motor operated rotary earth drilling tool, with a separate, removable air circulation control housing, with the circulation control valve in a closed position.

In FIGS. 12 and 13, there is shown a another embodiment of the air motor drilling tool 10 in which the circulation control housing 120 is provided as a removable sub which functions additionally as a drill stabilizer. Housing 120 includes a tubular section 121 having male threads 122 at one end which are threaded into female threads 29 on housing 15. The other end of tubular member 121 has female pipe threads 123 into which is threaded the male threaded end portion 124 of tubular housing member 125. Tubular housing member 125 has an inner bore 126 and smaller bore 127. Inner bore 126 has a sealing O-ring 128 in groove 129.

A tubular inlet member 130 is slidably positioned in the inner bore 126 of circulation control housing 120. Tubular inlet member 130 has an enlarged outer end portion 131 with female or box threads 132 opening into longitudinal passageway 133. Passageway 133 has a counterbore 134 and a further counterbore 135 in which there is fitted a conical screen filter 136. Housing member 125 has a counterbore 137 with a shoulder 138 at the entrance to passageway 126.

Tubular inlet member 130 has an outer portion 139 with an O.D. having a loose fit in the counterbore 137 of housing member 125. Tubular inlet member 130 has a smaller diameter portion 140 with an O.D. having a sliding fit in the inner bore 126 of housing 125 and is sealed against air leakage by bearing rings 141 and 142 in grooves 143 and 144, and sealing O-ring 128 in groove 129. Tubular inlet member 130 has discharge openings 145 in the wall thereof and external grooves 146 in the outer portion 139. In the position shown in FIG. 12, air flow entering through opening 132 is discharged through openings 145 and grooves 146 to discharge into the borehole and flush cuttings and debris therefrom.

An abutment plug 147 is secured in opening 148 in the wall of housing member 125 and extends into recess 149 in the smaller diameter portion 140 of tubular inlet member 130 to limit longitudinal and rotational movement thereof and to prevent it from being removed from housing member 125 during use. Abutment plug 147 has a flange portion 150 through which metal screws 151 extend to hold it in place. There are three of the abutment plugs 147 and recesses 149 spaced uniformly around the circulation control housing 120, although a greater or lesser number may be used as desired. Plate members 153 are secured over each of the abutment plugs 147 by metal screws 154. Plate members 153 are secured in recesses 155 and are of a wear resistant metal to function as stabilizers in the hole being drilled.

OPERATION

While the operation of this embodiment should be obvious from the foregoing description, it will be restated for clarity.

The tool is designed for drilling through hard soil or rock as in the embodiment of FIG. 1. It is placed in a drilling position and compressed air is introduced through inlet member 130 of circulation control housing 120. Air flow is through motor housing 12 to rotate the motor rotor. Air from the motor flows through annular passageway 49 around motor housing 12 and reduction gear housing 13 to keep them cool and dissipate heat produced by the high speed motor operation, as described above. Air flow from passageway 49 is discharged through bearing housing 14 with part of the air discharging through the peripheral opening around the bit sub and part flowing through the bit sub to flush cuttings and debris from the borehole.

In the position in FIG. 13, tubular inlet member 130 is mOVed forward as far as possible until openings 145 are completely inside bore 126 and sealed by O-ring 128 against air leakage. In this position, all of the compressed air flows through motor housing 12 to operate the motor rotor and discharge around the housings through passageway 49 as previously described. When the tubular member 130 is retracted, as shown in FIG. 12, the openings 145 are uncovered to let the air flow out through openings 145 and grooves 146. In this position, there is insufficient air pressure on the rotor vanes to rotate the motor and all of the air flows through openings 145. This is accomplished by lifting (in the case of vertical drilling) or pulling back (in the case of horizontal drilling) the drill string or air connection.

While this invention has been shown fully and completely with special emphasis on certain preferred embodiments, it should be understood that within the slope of the appended claims the invention may be practiced otherwise than as specifically described herein.

We claim:

1. An air motor operated rotary earth drilling tool, for use with a source of high pressure, high volume compressed air, comprising a circulation control housing, a motor housing, a reduction gear housing, and a bearing housing connected longitudinally in series, said circulation control housing having an inlet for connection to a source of high pressure, high volume, compressed air, an outlet opening into said motor housing, and an exhaust opening for discharge of compressed air for flushing cuttings and debris from a bore hole, said motor housing having an inlet connected to receive compressed air from said circulation control housing outlet, a motor chamber, an air motor rotor positioned therein with a rotary shaft extending into said reduction gear housing, and outlet opening for discharge of compressed air from said rotary air motor to said reduction gear housing, a reduction gear train supported in said reduction gear housing receiving said air motor rotor shaft and having a low speed, high torque output shaft extending into said bearing housing, said reduction gear housing having an inlet operatively connected to said motor housing outlet, an outlet connected to discharge compressed air to said bearing housing, and a passageway conducting compressed air around said reduction gear train in heat exchange relation therewith, said bearing housing having an inlet operatively connected to receive compressed air from said reduction gear housing, bearing means in said bearing housing supporting said reduction gear train output shaft for rotary movement, a hollow, rotary drill bit sub extending into said bearing housing and supported on said bearing means for rotation by said reduction gear train output shaft, said hollow, rotary drill bit sub having a passageway open to discharge compressed air from said motor and reduction gear housings to a bore hole in which the drilling tool is operated, said bearing housing having an opening permitting flow of part of said compressed air through said bearing means to discharge into a bore hole in which the drilling tool is operated, and valve means in said circulation control housing controlling said exhaust opening on longitudinal movement of said circulation control housing to direct flow of compressed air selectively to said motor housing or to said exhaust opening to split the flow of air through said bearing housing to flow part through the bearing means and part through said hollow, rotary drill bit sub.

2. An air motor operated rotary earth drilling tool according to claim 1 in which said reduction gear train is a planetary gear.

3. An air motor operated rotary earth drilling tool according to claim 1 in which said air motor rotor comprises a sliding vane rotor with vanes cooperable with the wall of said housing to be moved by introduction of compressed air to rotate said shaft.

4. An air motor operated rotary earth drilling tool according to claim 1 in which said reduction gear train is a planetary gear, said air motor rotor comprises a sliding vane rotor with vanes cooperable with the wall of said housing to be moved by introduction of compressed air to rotate said shaft.

5. An air motor operated rotary earth drilling tool according to claim 1 including an external housing in which said circulation control housing, motor housing, reduction gear housing, and bearing housing are supported and keyed to prevent rotational movement.

6. An air motor operated rotary earth drilling tool according to claim 1 in which said valve means in said circulation control housing comprises a tubular inlet member having an outer end extending outside said circulation control housing for connection to a source of compressed air and an inner end adjacent to the inlet to said motor housing, and being supported for longitudinal movement in said circulation control housing, and a valve member on tubular member inner end operable on longitudinal movement to open or close said circulation control housing exhaust opening to direct flow of compressed air selectively to said motor housing or to said exhaust opening.

7. An air motor operated rotary earth drilling tool according to claim 6 in which said motor housing has a tubular inlet member with a longitudinal opening to supply compressed air to said rotor, and peripheral openings which, when open, communicate with said exhaust opening, and said valve member comprising the inner end portion of said circulation control housing tubular inlet member having a sliding fit over said motor housing tubular inlet member, when extended, to close the peripheral openings thereon.

8. An air motor operated rotary earth drilling tool according to claim 1 in which said circulation control housing exhaust opening comprises a passageway bypassing flow of compressed air around said motor housing for discharge through said bearing housing and drill bit sub at a volume and flow rate sufficient for flushing cuttings and debris from a bore hole.

9. An air motor operated rotary earth drilling tool according to claim 1 in which said circulation control housing exhaust opening is several times larger than said circulation control housing outlet opening into said motor housing so that, when open, the discharge of compressed air is at a volume and flow rate sufficient for flushing cuttings and debris from a bore hole.

10. An air motor operated rotary earth drilling tool according to claim 1 including an external housing in which said circulation control housing, motor housing, reduction gear housing, and bearing housing are supported, and said circulation control housing exhaust opening comprises a passageway bypassing flow of compressed air through said external housing around said motor housing for discharge through said bearing housing and drill bit sub at a volume and flow rate sufficient for flushing cuttings and debris from a bore hole.

11. An air motor operated rotary earth drilling tool according to claim 1 in which an external housing in which said circulation control housing, motor housing, reduction gear housing, and bearing housing are supported, said motor and reduction gear housings being supported centrally in said external housing with an annular flow passageway extending from the inlet end of said motor housing to the outlet end of said reduction gear housing, and said circulation control housing exhaust opening comprises said annular passageway bypassing flow of compressed air through said external housing around said motor housing for discharge through said bearing housing and drill bit sub at a volume and flow rate sufficient for flushing cuttings and debris from a bore hole.

12. An air motor operated rotary earth drilling tool according to claim 11 including valve means in said circulation control housing controlling said exhaust opening to direct flow of compressed air selectively to said motor housing or to said exhaust opening.

13. An air motor operated rotary earth drilling tool according to claim 12 in which said valve means in said circulation control housing comprises a tubular inlet member having an outer end extending outside said circulation control housing for connection to a source of compressed air and an inner end adjacent to the inlet to said motor housing, and being supported for longitudinal movement in said circulation control housing, and a valve member on tubular member inner end operable on longitudinal movement to open or close said circulation control housing exhaust opening to direct flow of compressed air selectively to said motor housing or to said exhaust opening.

14. An air motor operated rotary earth drilling tool according to claim 1 in which an external housing in which said circulation control housing, motor housing, reduction gear housing, and bearing housing are supported, said motor housing and reduction gear housing being supported centrally in said external housing with an annular flow passageway extending longitudinally from the inlet end of said motor housing to the outlet end of said reduction gear housing, and said circulation control housing exhaust opening comprises said annular passageway bypassing flow of compressed air through said external housing around said motor housing for discharge through said bearing housing and drill bit sub at a volume and flow rate sufficient for flushing cuttings and debris from a bore hole, said circulation control housing exhaust opening being several times larger than said circulation control housing outlet opening into said motor housing so that, when open, the discharge of compressed air is at a volume and flow rate sufficient for flushing cuttings and debris from a bore hole.

15. An air motor operated rotary earth drilling tool according to claim 1 including an external housing in which said circulation control housing, motor housing, reduction gear housing, and bearing housing are supported, said motor housing and reduction gear housing being supported centrally in said external housing with an annular flow passageway extending longitudinally from the inlet end of said motor housing to the outlet end of said reduction gear housing, said circulation control housing exhaust opening comprises said annular passageway bypassing flow of compressed air through said external housing around said motor housing for discharge through said bearing housing and drill bit sub at a volume and flow rate sufficient for flushing cuttings and debris from a bore hole, valve means in said circulation control housing controlling said exhaust opening comprising a tubular inlet member having an outer end extending outside said circulation control housing for connection to a source of compressed air and an inner end adjacent to the inlet to said motor housing, and being supported for longitudinal movement in said circulation control housing, a valve member on tubular member inner end operable on longitudinal movement to open or close said circulation control housing exhaust opening to direct flow of compressed air selectively to said motor housing or to said exhaust opening, and said circulation control housing exhaust opening being several times larger than said circulation control housing outlet opening into said motor housing so that, when open, the discharge of compressed air is at a volume and flow rate sufficient for flushing cuttings and debris from a bore hole.

16. An air motor operated rotary earth drilling tool according to claim 15 in which said motor housing has a tubular inlet member with a longitudinal opening to supply compressed air to said rotor, and peripheral openings which, when open, communicate with said exhaust opening, and said valve member comprising the inner end portion of said circulation control housing tubular inlet member having a sliding fit over said motor housing tubular inlet member, when extended, to close the peripheral openings thereon.

17. An air motor operated rotary earth drilling tool, for use with a source of high pressure, high volume compressed air, comprising a motor housing, a reduction gear housing, and a bearing housing connected longitudinally in series, said motor housing having an inlet for receiving compressed air for operation, a motor chamber, an air motor rotor positioned therein with rotary shaft extending into said reduction gear housing, and outlet opening for discharge of compressed air from said rotary air motor to said reduction gear housing, a reduction gear train supported in said reduction ear housing receiving said air motor rotor shaft and having a low speed, high torque output shaft extending into said bearing housing, said reduction gear housing having an inlet connected to said motor housing outlet, an outlet connected to discharge compressed air to said bearing housing, and a passageway conducting compressed air around said reduction gear train in heat exchange relation therewith, said bearing housing having an inlet connected to receive compressed air from said reduction gear housing, bearing means in said bearing housing supporting said reduction gear train output shaft for rotary movement, a hollow, rotary drill bit sub extending into said bearing housing and supported on said bearing means for rotation by said reduction gear train output shaft, said hollow, rotary drill bit sub having a passageway open to discharge compressed air from said motor and reduction gear housings to a bore hole in which the drilling tool is operated, said bearing housing having an opening permitting flow of part of said compressed air through said bearing means to discharge into a bore hole in which the drilling tool is operated, and a circulation control housing removably supported on said motor housing, said circulation control housing having an inlet for connection to a source of high pressure, high volume, compressed air, an outlet opening into said motor housing, and an exhaust opening for discharge of compressed air behind the motor for flushing cuttings and debris from a bore hole.

18. An air motor operated rotary earth drilling tool according to claim 17 including valve means in said circulation control housing controlling said exhaust opening to direct flow of compressed air selectively to said motor housing or to said exhaust opening.

19. An air motor operated rotary earth drilling tool according to claim 17 including valve means in said circulation control housing controlling said exhaust opening to direct flow of compressed air selectively to said motor housing or to said exhaust opening comprising a tubular inlet member having an outer end extending outside said circulation control housing for connection to a source of compressed air and being supported for longitudinal movement therein, and valve means on said tubular member operable on longitudinal movement to open or close said circulation control housing exhaust opening to control flow of compressed air therethrough.

20. An air motor operated rotary earth drilling tool according to claim 17 including a tubular inlet member having an outer end extending outside said circulation control housing for connection to a source of compressed air and being supported for longitudinal movement therein, said tubular inlet member having passageways in the wall thereof open to discharge air to the borehole, and said tubular inlet member being operable on longitudinal movement to open or close said passageways to control flow of compressed air therethrough and thus direct flow of compressed air selectively to said motor housing or to the borehole.

21. An air motor operated rotary earth drilling tool according to claim 20 in which said circulation control housing has abutment means limiting the longitudinal movement of said tubular inlet member to prevent removal therefrom on outward movement to the opened position.

22. A circulation control sub for use with an air motor operated rotary earth drilling tool operated by high pressure, high volume compressed air, comprising a motor housing, a reduction gear housing, and a bearing housing connected longitudinally in series, said motor housing having an inlet for receiving compressed air for operation, a motor chamber, an air motor rotor positioned therein with a rotary shaft extending into said reduction gear housing, and outlet opening for discharge of compressed air from said rotary air motor to said reduction gear housing, a reduction gear train supported in said reduction gear housing receiving said air motor rotor shaft and having a low speed, high torque output shaft extending into said bearing housing, said reduction gear housing having an inlet connected to said motor housing outlet, an outlet connected to discharge compressed air to said bearing housing, and a passageway conducting compressed air around said reduction gear train in heat exchange relation therewith, said bearing housing having an inlet connected to receive compressed air from said reduction gear housing, bearing means in said bearing housing supporting said reduction gear train output shaft for rotary movement, a hollow, rotary drill bit sub extending into said bearing housing and supported on said bearing means for rotation by said reduction gear train output shaft, said hollow, rotary drill bit sub having a passageway open to discharge compressed air from said motor and reduction gear housings to a bore hole in which the drilling tool is operated, said bearing housing having an opening permitting flow of part of said compressed air through said bearing means to discharge into a bore hole in which the drilling tool is operated, said circulation control sub comprising a circulation control housing adapted to be removably supported on said motor housing, said circulation control housing having an inlet for connection to a source of high pressure, high volume, compressed air, an outlet opening into said motor housing, and an exhaust opening for discharge of compressed air behind the motor for flushing cuttings and debris from a bore hole.

23. A circulation control sub according to claim 22 including valve means in said circulation control housing controlling said exhaust opening to direct flow of compressed air selectively to said motor housing or to said exhaust opening.

24. A circulation control sub according to claim 22 including valve means in said circulation control housing controlling said exhaust opening to direct flow of compressed air selectively to said motor housing or to said exhaust opening comprising a tubular inlet member having an outer end extending outside said circulation control housing for connection to a source of compressed air and being supported for longitudinal movement therein, and valve means on said tubular member operable on longitudinal movement to open or close said circulation control housing exhaust opening to control flow of compressed air.

25. A circulation control sub according to claim 22 including a tubular inlet member having an outer end extending outside said circulation control housing for connection to a source of compressed air and being supported for longitudinal movement therein, said tubular inlet member having passageways in the wall thereof open to discharge air to the borehole, and said tubular inlet member being operable on longitudinal movement to open or close said passageways to control flow of compressed air therethrough and thus direct flow of compressed air selectively to said motor housing or to the borehole.

26. A circulation control sub according to claim 25 including said circulation control housing has abutment means limiting the longitudinal movement of said tubular inlet member to prevent removal therefrom on outward movement to the opened position.

27. A method of earth drilling comprising the steps of (a) providing an air motor operated rotary earth drilling tool, for use with a source of high pressure, high volume compressed air, which tool comprises a circulation control housing, a motor housing, a reduction gear housing, and a bearing housing connected longitudinally in series, said circulation control housing having an inlet for connection to a source of high pressure, high volume, compressed air, an outlet opening into said motor housing, and an exhaust opening, said motor housing having an inlet connected to said circulation control housing outlet, a motor chamber, an air motor rotor positioned therein with a rotary shaft extending into said reduction gear housing, and outlet opening, a reduction gear train supported in said reduction gear housing receiving said air motor rotor shaft and having a low speed, high torque output shaft extending into said bearing housing, said reduction gear housing having an inlet connected to said motor housing outlet, an outlet, and a passageway around said reduction gear train, said bearing housing having an inlet connected to said reduction gear housing, bearing means in said bearing housing supporting said reduction gear train output shaft for rotary movement, a hollow, rotary drill bit sub extending into said bearing housing and supported on said bearing means for rotation by said reduction gear train output shaft, a drill bit with openings for flow of air therethrough supported on said drill bit sub, and said bearing housing having an opening through said bearing means for discharge into a bore hole, (b) positioning said drilling tool with said drill bit in earth boring relation, (c) passing compressed air at high volume and high pressure through said drilling tool to rotate said air motor at high speed and low torque, (d) said reduction gear means reducing the speed of rotation to effect a low speed high torque rotation of said drill bit, (e) passing compressed air from said air motor over said reduction gear housing to cool the same, (f) passing part of the compressed air through said bearing means and discharging the same from said bearing housing, and (g) passing the remainder of said compressed air through said drill bit sub and drill bit into the bore hole to flush cuttings and debris therefrom.

28. A method according to claim 27 in which said circulation control housing includes valve means controlling said exhaust opening to direct flow of compressed air selectively to said motor housing or to said exhaust opening, and including the further step of operating said valve means to circulate compressed air into the borehole at selected times to clean the borehole.

29. A method according to claim 28 in which said valve means in said circulation control housing comprises a tubular inlet member having an outer end extending outside said circulation control housing for connection to a source of compressed air and an inner end adjacent to the inlet to said motor housing, and being supported for longitudinal movement in said circulation control housing, and a valve member on tubular member inner end, said step of operating said valve member comprises moving said tubular inlet member longitudinally to open or close said circulation control housing exhaust opening to direct flow of compressed air selectively to said motor housing or to said exhaust opening.

* * * * *